US009785113B2

(12) United States Patent
Takezawa

(10) Patent No.: US 9,785,113 B2
(45) Date of Patent: Oct. 10, 2017

(54) IMAGE FORMING APPARATUS

(71) Applicant: KYOCERA Document Solutions Inc., Osaka (JP)

(72) Inventor: Mashio Takezawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 15 days.

(21) Appl. No.: 15/182,870

(22) Filed: Jun. 15, 2016

(65) Prior Publication Data

US 2016/0370759 A1 Dec. 22, 2016

(30) Foreign Application Priority Data

Jun. 18, 2015 (JP) ..... 2015-122827

(51) Int. Cl.
*G03G 15/00* (2006.01)
*G03G 21/20* (2006.01)
*G03G 15/04* (2006.01)

(52) U.S. Cl.
CPC ..... *G03G 21/206* (2013.01); *G03G 15/0409* (2013.01); *G03G 15/04036* (2013.01)

(58) Field of Classification Search
CPC combination set(s) only.
See application file for complete search history.

(56) References Cited

U.S. PATENT DOCUMENTS 6,266,498 B1 7/2001 Oda et al.
2007/0044830 A1* 3/2007 Uemura ..... H01L 31/048 136/251
2008/0025750 A1* 1/2008 Yamazaki ..... G02B 26/121 399/92

FOREIGN PATENT DOCUMENTS

JP 2000-235287 A 8/2000

* cited by examiner

*Primary Examiner* — Minh Phan
(74) *Attorney, Agent, or Firm* — Studebaker & Brackett PC

(57) ABSTRACT

An image forming apparatus includes an optical system unit and an attachment board. The optical system unit forms an electrostatic latent image by irradiating an image bearing member with light. The optical system unit is attached to the attachment board. The attachment board includes a mounting surface, a first recess portion, and a second recess portion. The optical system unit is mounted on the mounting surface. The first recess portion and the second recess portion are provided in the mounting surface to form air paths. The first recess portion is located below a lower surface of the optical system unit, extending in a first direction. The second recess portion is located below the lower surface of the optical system unit, extending in a direction different from the first direction and crossing the first recess portion.

20 Claims, 10 Drawing Sheets

IMAGE FORMING APPARATUS

INCORPORATION BY REFERENCE

The present application claims priority under 35 U.S.C. §119 to Japanese Patent Application No. 2015-122827, filed Jun. 18, 2015. The contents of this application are incorporated herein by reference in their entirety.

BACKGROUND

The present disclosure relates to image forming apparatuses.

An image forming apparatus includes, for example, an exposure device (an optical system unit for exposure), a development device, a transfer device, and a fixing device. The exposure device irradiates the surface of a photosensitive drum with light to form an electrostatic latent image.

In image forming apparatuses, the accuracy of light irradiation performed by the exposure device is affected by heat that is generated during thermocompression bonding performed by the fixing device. This problem is addressed by a certain known technique.

In the certain technique, the exposure device is cooled by cooling air from an air blower. This can prevent influence by heat generated during thermocompression bonding performed by the fixing device on the accuracy of light irradiation performed by the exposure device.

SUMMARY

An image forming apparatus according to the present disclosure includes an optical system unit and an attachment board. The optical system unit forms an electrostatic latent image by irradiating an image bearing member with light. The optical system unit is attached to the attachment board. The attachment board includes a mounting surface, a first recess portion, and a second recess portion. The optical system unit is mounted on the mounting surface. The first recess portion and the second recess portion are provided in the mounting surface to form air paths. The first recess portion is located below a lower surface of the optical system unit, extending in a first direction. The second recess portion is located below the lower surface of the optical system unit, extending in a direction different from the first direction and crossing the first recess portion.

DETAILED DESCRIPTION

First Embodiment

Figure 1:
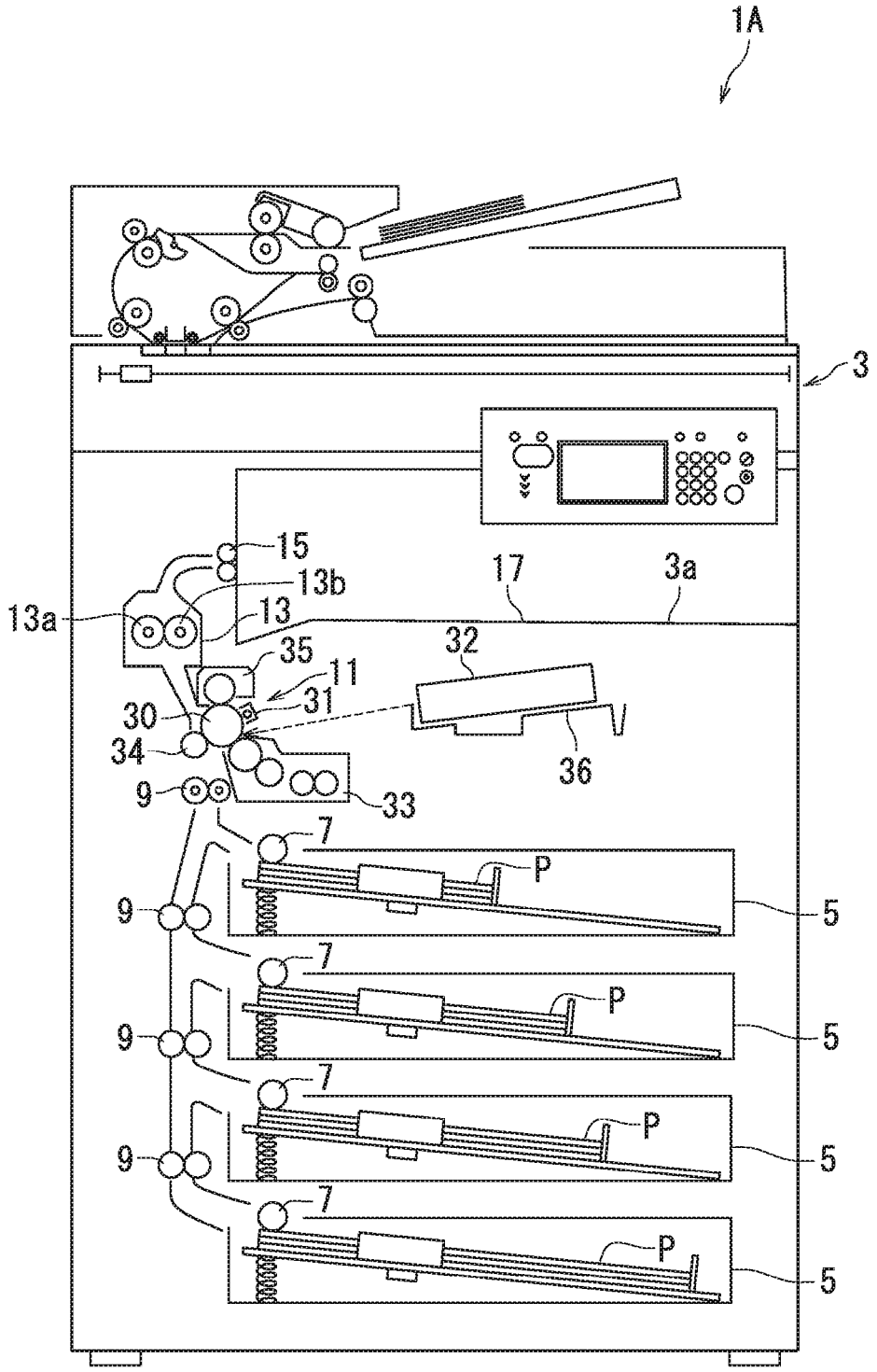
FIG. 1 illustrates a configuration of an image forming apparatus according to a first embodiment.

An image forming apparatus 1A according to a first embodiment forms an image on paper. The image forming apparatus 1A includes a housing 3, a paper feed cassette 5, a paper feed roller 7, a conveyance roller 9, an image forming section 11, a fixing section 13, a paper ejection roller 15, and an exit tray 17.

The housing 3 accommodates the components of the image forming apparatus 1A (i.e., the paper feed cassette 5, the paper feed roller 7, the conveyance roller 9, the image forming section 11, the fixing section 13, and the paper ejection roller 15). An in-body space 3*a* with an open side is provided in an upper portion of the housing 3.

The paper feed roller 7 picks a plurality of sheets of paper P stored in the paper feed cassette 5 on a sheet-by-sheet basis. The conveyance roller 9 conveys the paper P picked by the paper feed roller 7 to the image forming section 11.

The image forming section 11 forms an image on the paper P supplied by the paper feed cassette 5. The image forming section 11 includes a photosensitive drum 30 (image bearing member), a charger 31, an exposure device 32 (optical system unit), a development device 33, a transfer roller 34, a cleaning device 35, and an attachment board 36.

The photosensitive drum 30 has a photosensitive layer on the surface thereof. The charger 31 uniformly charges the surface of the photosensitive drum 30 to a predetermined potential. The exposure device 32 irradiates the charged surface of the photosensitive drum 30 with laser light. As a result, the exposure device 32 forms an electrostatic latent image corresponding to image data on the surface of the photosensitive drum 30. The development device 33 develops the electrostatic latent image on the surface of the photosensitive drum 30 using toner (e.g., black toner) to form a toner image.

The transfer roller 34 transfers the toner image on the surface of the photosensitive drum 30 to the paper P. The transfer roller 34 and the photosensitive drum 30 form a transfer nip region therebetween. A transfer voltage is applied to the transfer roller 34. As a result, when the toner image on the surface of the photosensitive drum 30 passes together with the paper P through the transfer nip region, the toner image is transferred to the paper P by the electrostatic attraction of the transfer roller 34. The cleaning device 35 removes residual toner from the surface of the photosensitive drum 30 after the transfer.

The attachment board 36 is used to secure the exposure device 32 to the housing 3. The attachment board 36 is secured to the housing 3 at a predetermined position.

The fixing section 13 fixes the toner image transferred to the paper P. The fixing section 13 includes a pressure roller 13*a* and a fixing roller 13*b*. The fixing roller 13*b* has a heat source. The heat source is used to heat the paper P. The fixing roller 13*b* and the pressure roller 13*a* form a fixing nip region therebetween. When the paper P passes through the fixing nip region, the toner image is fixed to the paper P by the heat of the fixing roller 13*b*. The paper ejection roller 15 ejects the paper P with the fixed toner image thereon to the exit tray 17.

Figure 2:
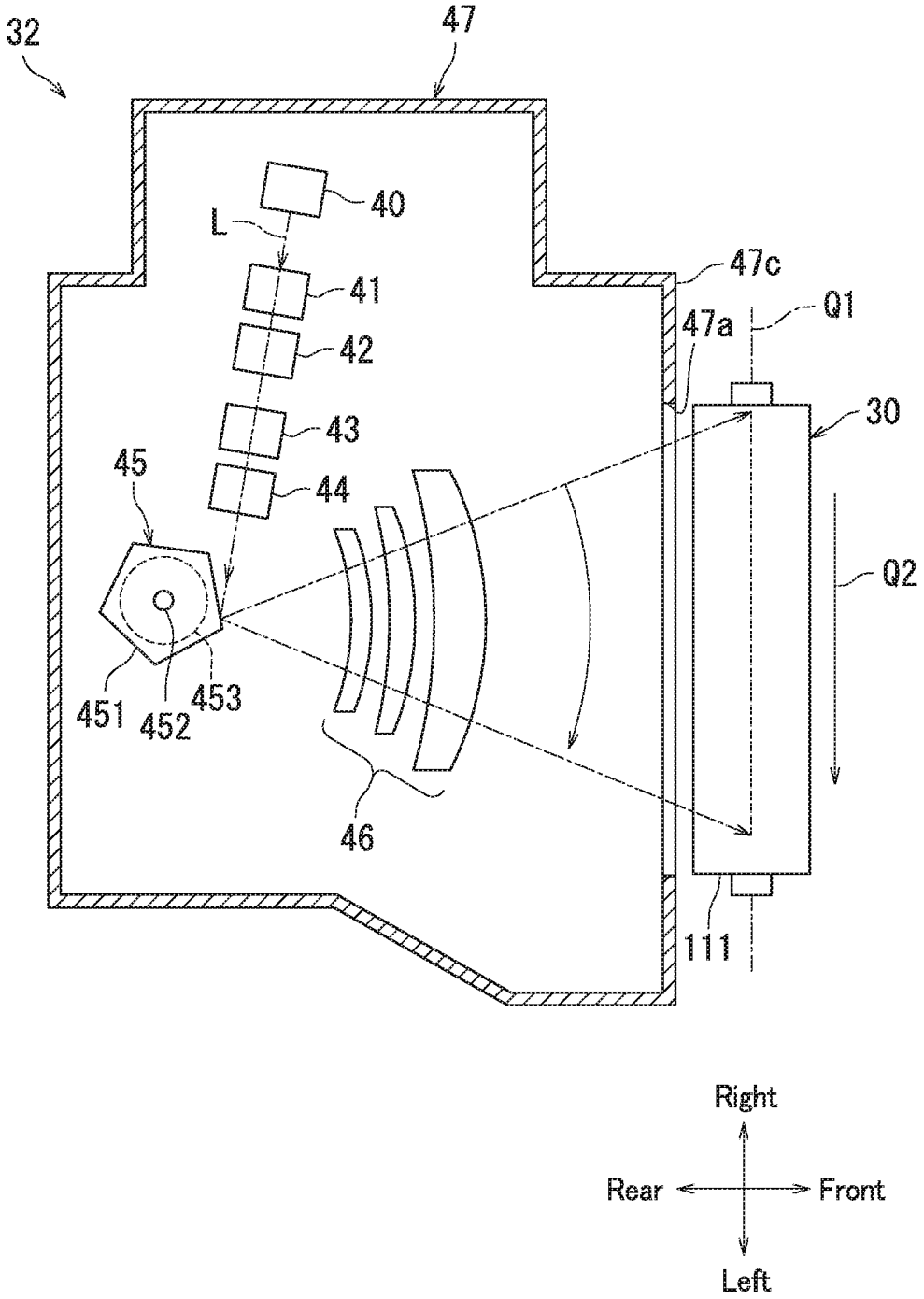
FIG. 2 is a transparent plan view showing a configuration of an exposure device according to the first embodiment.

Referring to FIG. 2, the exposure device 32 includes a light source 40, a collimating lens 41, a first aperture stop 42, a cylindrical lens 43, a second aperture stop 44, an optical deflector 45, an fθ lens 46, and a housing 47.

The housing 47 accommodates the components of the exposure device 32 (i.e., the light source 40, the collimating lens 41, the first aperture stop 42, the cylindrical lens 43, the second aperture stop 44, the optical deflector 45, and the fθ lens 46). The housing 47 is in the shape of a flat box which is substantially rectangular as viewed from above. A light emission opening 47*a* is provided in a front wall 47*c* of the housing 47. Laser light is emitted through the light emission opening 47*a*.

The optical deflector 45 is disposed in the housing 47. The optical deflector 45 is located away from the light emission opening 47*a*, facing the light emission opening 47*a*. Specifically, the optical deflector 45 is disposed behind the center of the internal space of the housing 47. The light source 40 is disposed at an end portion of the internal space of the housing 47. This end portion of the internal space of the housing 47 is one end portion (e.g., a right end portion) in a direction crossing the direction in which the optical deflector 45 faces the light emission opening 47*a*, in the housing 47. The collimating lens 41, the first aperture stop 42, the cylindrical lens 43, and the second aperture stop 44 are disposed between the light source 40 and the optical deflector 45 in this order, where the collimating lens 41 is closest to the light source 40. The fθ lens 46 is disposed between the optical deflector 45 and the light emission opening 47*a*.

The light source 40 outputs laser light L having an intensity corresponding to image data. The collimating lens 41 converts the laser light L output from the light source 40 into collimated light. The first aperture stop 42 limits the beam spot size of the collimated light output from the collimating lens 41. The cylindrical lens 43 focuses the collimated light output from the first aperture stop 42 onto a reflection surface of the optical deflector 45 through the second aperture stop 44. The second aperture stop 44 limits the beam spot size of the collimated light output from the cylindrical lens 43.

The optical deflector 45 causes the collimated light output from the second aperture stop 44 to sweep across the fθ lens 46. The optical deflector 45 includes a rotating polygon mirror 451 and a drive motor 453 (electric motor). The rotating polygon mirror 451 reflects the collimated light output from the second aperture stop 44 toward the fθ lens 46. The rotating polygon mirror 451 is in the shape of a plate which is regular-polygonal as viewed from above, and has a number of mirrors (i.e., reflection surfaces) on the circumferential surface thereof. The rotating polygon mirror 451 is rotatably disposed. The drive motor 453 drives the rotating polygon mirror 451 to rotate at a constant angular rate. As a result, the collimated light reflected by the reflection surface of the rotating polygon mirror 451 sweeps across the fθ lens 46 at a constant angular rate.

The fθ lens 46 refracts the collimated light which is caused by the rotating polygon mirror 451 to sweep at a constant angular rate. As a result, the refracted collimated light sweeps across the photosensitive drum 30 at a constant speed. The collimated light refracted by the fθ lens 46 is emitted out through the light emission opening 47*a*. The collimated light that is emitted sweeps across the photosensitive drum 30 in a predetermined sweeping direction Q2 at a constant speed. The collimated light irradiates the photosensitive drum 30. Note that the axial direction Q1 of the axis of rotation of the photosensitive drum 30 is parallel to the sweeping direction Q2 of the collimated light.

Figure 3:
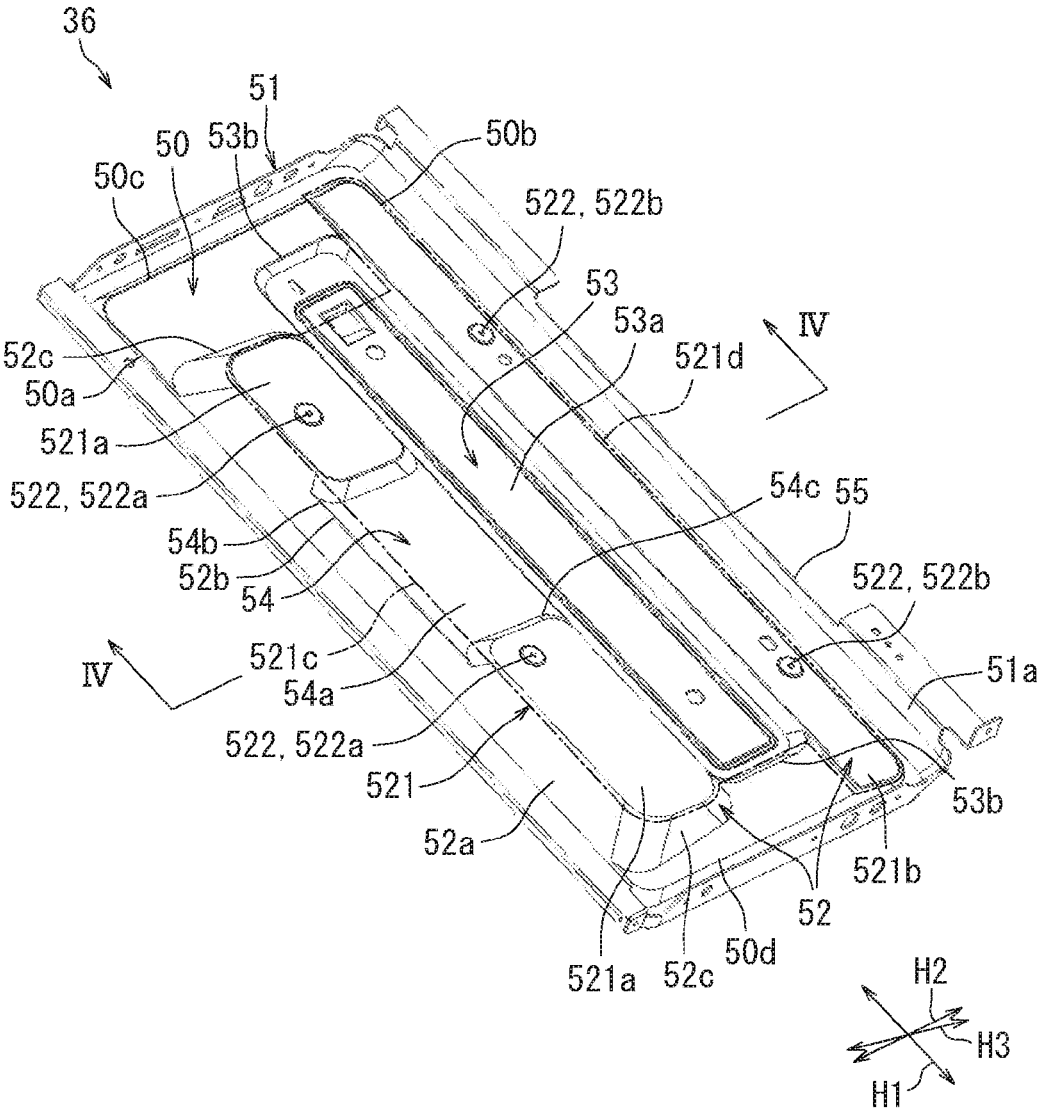
FIG. 3 is a perspective view of an attachment board according to the first embodiment.

Next, referring to FIG. 3, the attachment board 36 secures the exposure device 32 to the housing 3, and cools the exposure device 32. The attachment board 36 is formed of, for example, a metal, which is shaped by sheet metal forming. As shown in FIG. 3, the attachment board 36 is in the shape of a shallow dish which is rectangular as viewed from above, for example. The attachment board 36 has a bottom surface 50, a perimeter wall 51, a platform portion 52, a first recess portion 53, a second recess portion 54, and an opening 55.

The bottom surface 50 is, for example, rectangular. The bottom surface 50 has a pair of longer sides 50*a* and 50*b* and a pair of shorter sides 50*c* and 50*d*. The attachment board 36 has a longitudinal direction H1 which is a direction along the longer sides 50*a* and 50*b*, and a transverse direction H2 which is a direction along the shorter sides 50*c* and 50*d*.

The perimeter wall 51 is provided around the bottom surface 50, surrounding the bottom surface 50. The platform portion 52 causes the exposure device 32 to be inclined with respect to the bottom surface 50. The platform portion 52 is provided on the bottom surface 50. The platform portion 52 has a mounting surface 521 and a plurality of (e.g., four) protrusions 522.

The mounting surface 521 is an upper surface of the platform portion 52 where the exposure device 32 is mounted. The mounting surface 521 is, for example, substantially rectangular. The mounting surface 521 is surrounded by the perimeter wall 51. The mounting surface 521 is inclined in the transverse direction H2. Specifically, the mounting surface 521 is inclined downward from the longer side 50*a* to the longer side 50*b* of the bottom surface 50. The inclination allows the laser light output by the exposure device 32 to appropriately irradiate the photosensitive drum 30. The longitudinal direction of the mounting surface 521 coincides with the longitudinal direction H1. The transverse direction H3 of the mounting surface 521 is inclined with respect to the transverse direction H2. The mounting surface 521 has a pair of longer sides 521*c* and 521*d*. The pair of longer sides 521*c* and 521*d* is sides of the mounting surface 521 along the longitudinal direction H1. The longer side 521*c* is located close to the longer side 50*a* of the bottom surface 50, and the longer side 521*d* is located close to the longer side 50*b* of the bottom surface 50.

The first recess portion 53 and the second recess portion 54 each form an air path for allowing cooling air for cooling the exposure device 32 to flow, on the mounting surface 521. The first recess portion 53 and the second recess portion 54 extend different directions and cross each other.

Specifically, the first recess portion 53 is disposed at substantially the center of the mounting surface 521 in the transverse direction H3. The first recess portion 53 extends in the longitudinal direction H1 (first direction) of the mounting surface 521. The first recess portion 53 extends in the longitudinal direction H1 from near the shorter side 50*c* of the bottom surface 50 to near the shorter side 50*d* of the bottom surface 50. Opposite end portions 53*b* of the first recess portion 53 in the longitudinal direction H1 are open to opposite side surfaces 52*c* of the platform portion 52 in the longitudinal direction H1.

The second recess portion 54 is disposed at substantially the center of the mounting surface 521 in the longitudinal direction H1. The second recess portion 54 extends in the transverse direction H3 (second direction) of the mounting surface 521. One end portion 54*b* of the second recess portion 54 in the extending direction (i.e., the transverse direction H3) is open to a side surface 52*a* of the platform portion 52. In other words, an airflow opening 52*b* is provided in the side surface 52*a*, and the end portion 54*b* is in communication with the airflow opening 52*b*. The side surface 52*a* is a side surface of the platform portion 52 which is close to the longer side 50*a* of the bottom surface 50. The other end portion 54*c* of the second recess portion 54 in the extending direction is in communication with the first recess portion 53. In other words, the second recess portion 54 crosses the first recess portion 53.

The protrusions 522 are a supporting point for supporting the exposure device 32. The protrusions 522 are in the shape of, for example, a flat cylinder. Of the four protrusions 522, two protrusions 522*a* are provided in two respective regions 521*a* of the mounting surface 521. The other two protrusions 522*b* are provided in a region 521*b* of the mounting surface 521. The two protrusions 522*b* are separated from each other in the longitudinal direction H1. The two regions 521*a* of the mounting surface 521 are located on one side (i.e., close to the longer side 521*c*) of the first recess portion 53 in the transverse direction H3 and on the opposite sides of the second recess portion 54 in the longitudinal direction H1. The region 521*b* of the mounting surface 521 is located on the other side (i.e., close to the longer side 521*d*) of the first recess portion 53 in the transverse direction H3.

The laser light output from the exposure device 32 passes through the opening 55. The cooling air flowing in the second recess portion 54 passes through the opening 55. The opening 55 is provided in a wall portion 51*a* of the perimeter wall 51. The opening 55 is in communication with the outside and inside of the wall portion 51*a*. The wall portion 51*a* is a portion of the perimeter wall 51 which is located close to the longer side 50*b* of the bottom surface 50.

Figure 4:
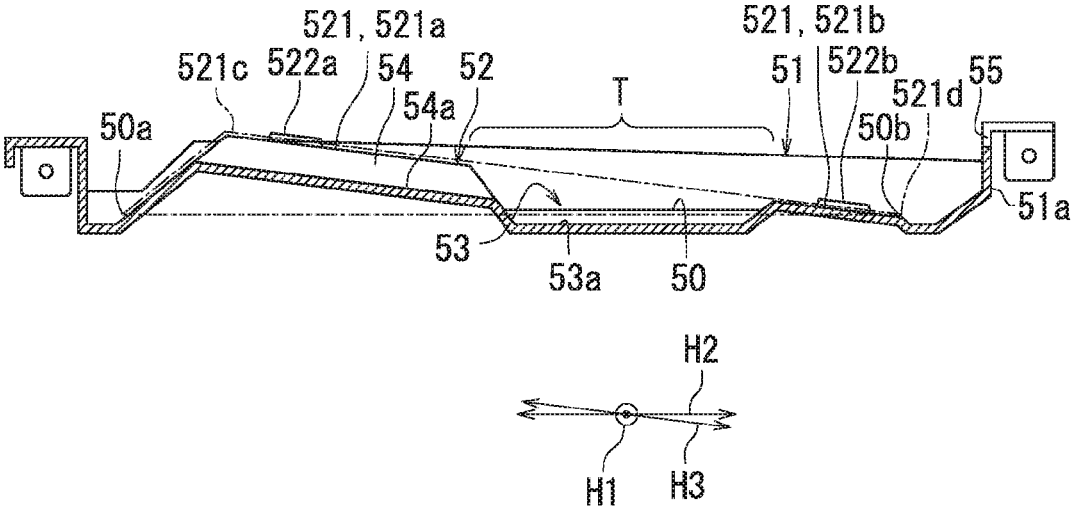
FIG. 4 is a cross-sectional view taken along line IV-IV of FIG. 3.

As shown in FIG. 4, the platform portion 52 is provided on the bottom surface 50. The mounting surface 521 is inclined in the transverse direction H3. The longer side 521*c* of the mounting surface 521 is located higher than the bottom surface 50. The longer side 521*d* of the mounting surface 521 is located at the same height as that of the bottom surface 50, for example.

A bottom surface 53*a* of the first recess portion 53 is located lower than the bottom surface 50. A bottom surface 54*a* of the second recess portion 54 is located higher than the bottom surface 50. Therefore, the bottom surface 54*a* of the second recess portion 54 is located higher than the bottom surface 53*a* of the first recess portion 53. Therefore, an air path formed by the first recess portion 53 and an air path formed by the second recess portion 54 cross each other at different heights. Specifically, at a crossing portion T, the air path formed by the first recess portion 53 is located below the air path formed by the second recess portion 54. As a result, air flowing in the first recess portion 53 and air flowing in the second recess portion 54 are prevented from colliding with each other at the crossing portion T.

Figure 5:
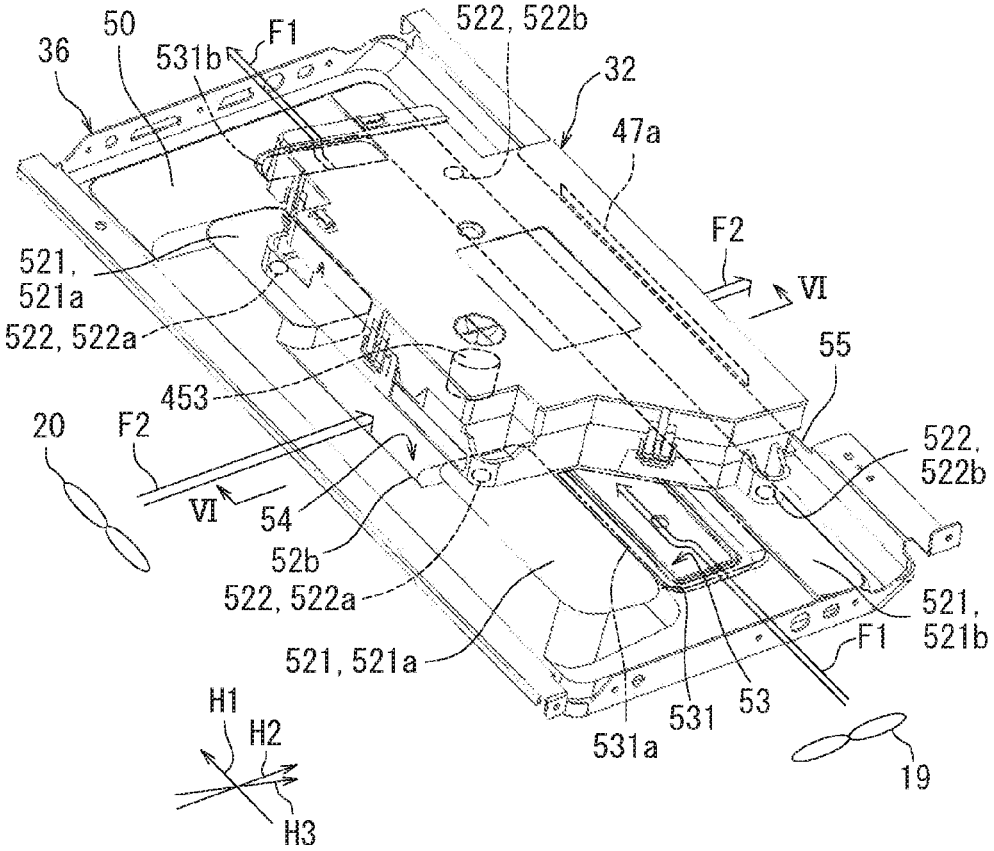
FIG. 5 is a perspective view showing an attachment board to which an exposure device is attached in the first embodiment.

Referring next to FIG. 5, the exposure device 32 is mounted on the four protrusions 522 on the mounting surface 521 of the attachment board 36. The light emission opening 47*a* of the exposure device 32 faces diagonally downward in the transverse direction H3, and is opposite the opening 55. The second recess portion 54 is located below the drive motor 453 of the exposure device 32. The first recess portion 53 is located below the exposure device 32. Opposite end portions of an open upper surface 531 of the first recess portion 53 in the longitudinal direction H1 are exposed from opposite sides of the exposure device 32 in the longitudinal direction H1, and function as airflow openings 531*a* and 531*b* of the first recess portion 53. The exposure device 32 is fastened to the attachment board 36 using fastening parts, such as screws, etc. (not shown). The attachment board 36 is secured to a predetermined position in the housing 3.

The image forming apparatus 1A further includes two air blowers 19 and 20 (a first air blower and a second air blower). The air blower 19 supplies cooling air F1 to the first recess portion 53 of the attachment board 36. The air blower 20 supplies cooling air F2 to the second recess portion 54 of the attachment board 36. The cooling air F1 and the cooling air F2 flows in the first recess portion 53 and the second recess portion 54, respectively. As a result, the exposure device 32 is cooled. Specifically, the cooling air F1 and the cooling air F2 flows through the attachment board 36 in two different directions. Therefore, compared to when cooling air flows in a single direction, the exposure device 32 is more effectively cooled.

As shown in FIG. 5, the cooling air F1 flows into the first recess portion 53 through the airflow opening 531*a*. Thereafter, the cooling air F1 flows in the first recess portion 53 in the longitudinal direction H1 to reach an area below the fθ lens 46 of the exposure device 32 (see FIG. 3). When passing through this area, the cooling air F1 cools the exposure device 32. Thereafter, the cooling air F1 flows out of the first recess portion 53 through the airflow opening 531*b*, and then flows out of the attachment board 36. In particular, the cooling air F1 reaches an area below the fθ lens 46, and thereby effectively cools the fθ lens 46.

Figure 6:
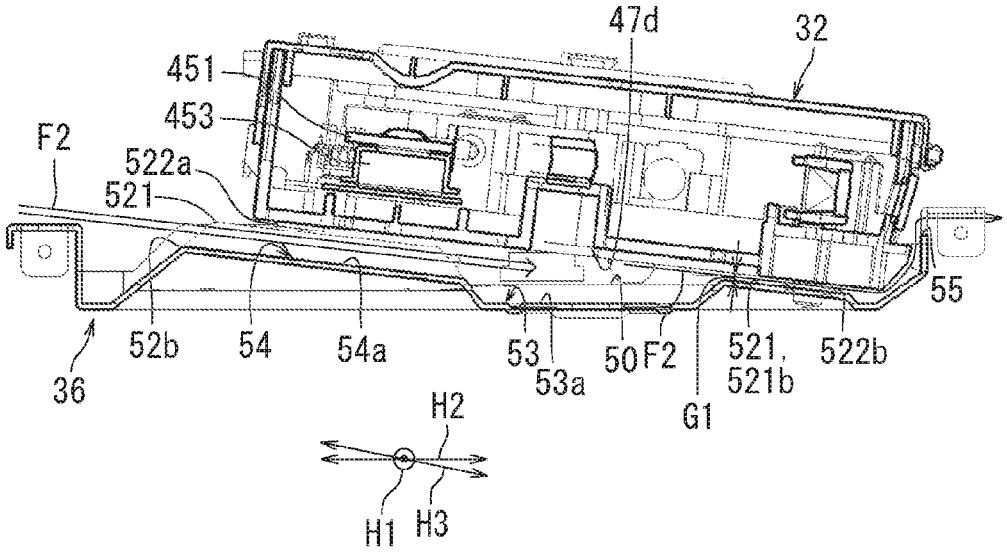
FIG. 6 is a cross-sectional view taken along line VI-VI of FIG. 5.

As shown in FIG. 6, the cooling air F2 flows into the second recess portion 54 through the airflow opening 52*b*. Thereafter, the cooling air F2 flows in the second recess portion 54 in the transverse direction H3 to reach an area below the drive motor 453 of the exposure device 32. The cooling air F2 further flows across the first recess portion 53 in the transverse direction H3 and then through a gap G1. The gap G1 is located between the region 521*b* of the mounting surface 521 and a lower surface 47*d* of the exposure device 32. The gap G1 is ensured by the protrusion 522*b* provided in the region 521*b*. Thereafter, the cooling air F2 flows out of the gap G1 in the transverse direction H3, and then flows out of the attachment board 36 through the opening 55 of the attachment board 36. The cooling air F2 cools the exposure device 32. In particular, the cooling air F2 flows through an area below the drive motor 453, and thereby effectively cools the drive motor 453.

Although, in the first embodiment, the second recess portion 54 is located below the drive motor 453, the first recess portion 53 may be located below the drive motor 453.

Although, in the first embodiment, the bottom surface 54*a* of the second recess portion 54 is located higher than the bottom surface 53*a* of the first recess portion 53, the bottom surface 53*a* of the first recess portion 53 may be located higher than the bottom surface 54*a* of the second recess portion 54.

Second Embodiment

Figure 7:
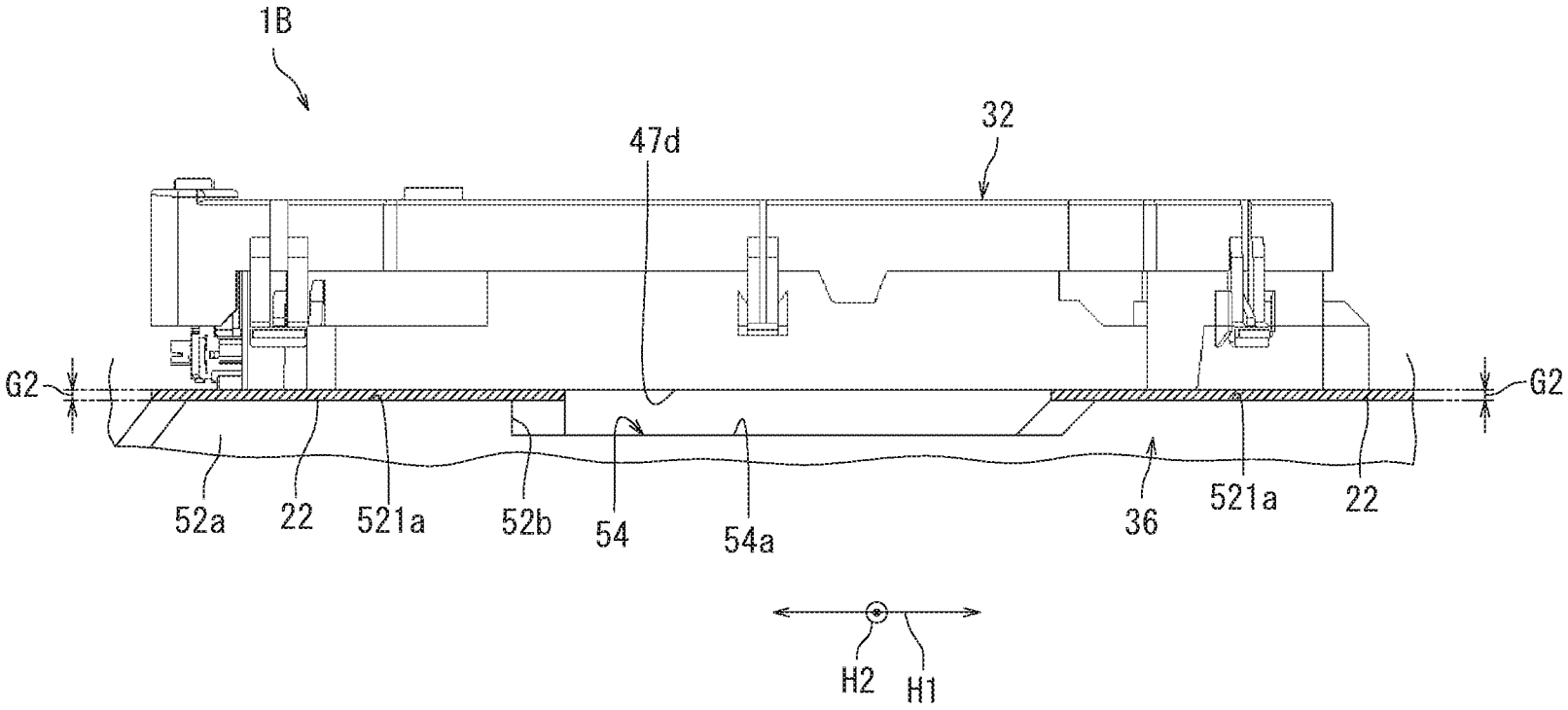
FIG. 7 is a side view showing a gap between an exposure device and an attachment board in a second embodiment.
Figure 8:
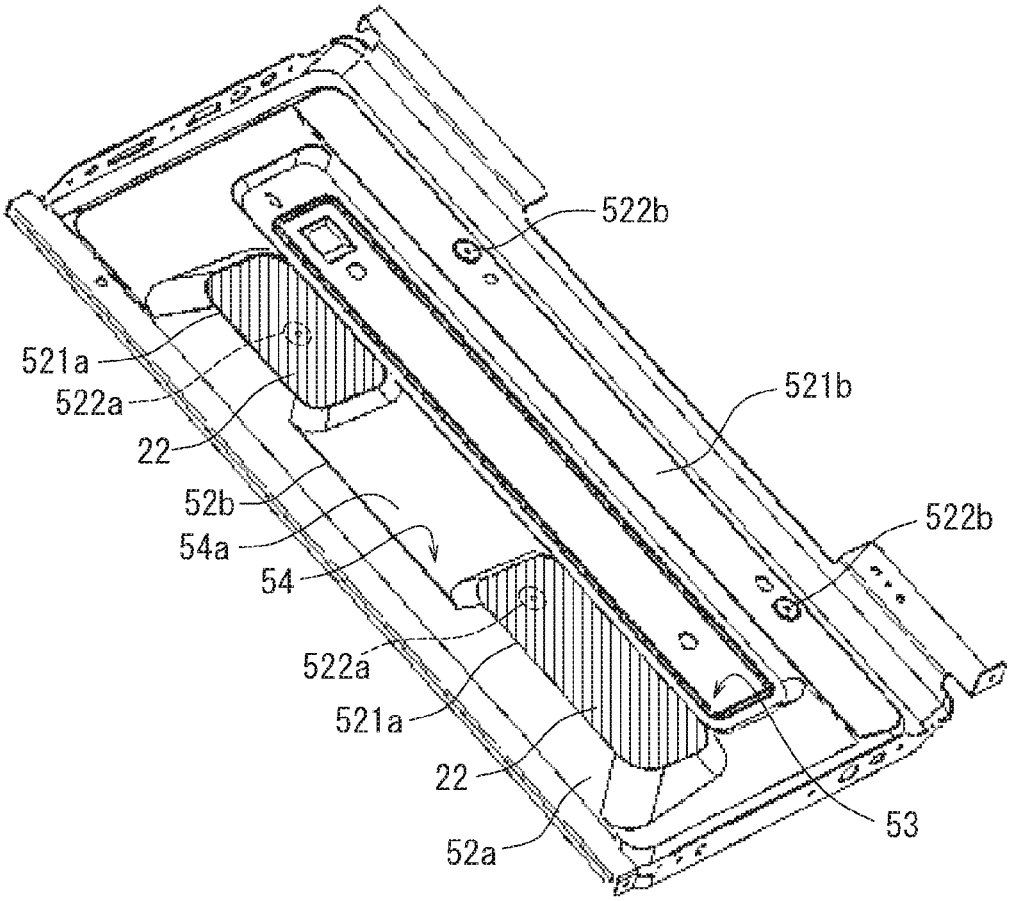
FIG. 8 is a perspective view of an attachment board according to the second embodiment.

In FIGS. 7 and 8, the same components as those of the first embodiment are indicated by the same reference signs and will not be described.

As shown in FIG. 7, an image forming apparatus 1B according to a second embodiment further includes a sealing member 22 in addition to the components of the image forming apparatus 1A of the first embodiment. The sealing member 22 is sandwiched between the lower surface 47*d* of the exposure device 32 and the region 521*a* of the mounting surface 521 to block a gap G2. The gap G2 is located between the lower surface 47*d* of the exposure device 32 and the region 521*a* of the mounting surface 521.

As shown in FIG. 8, the sealing member 22 entirely covers both of the regions 521*a*, for example. In FIG. 8, the sealing member 22 is indicated by hatching. The sealing member 22 is attached to, for example, the regions 521*a*. The sealing member 22 is in the shape of a sheet. The sealing member 22 is formed of, for example, a low-resilient and thermally-conductive material (e.g., silicone rubber). Because of the low resilience of the sealing member 22, the inclination of the exposure device 32 is not substantially affected even when the sealing member 22 is disposed in the gap G2. Because of the thermal conductivity of the sealing member 22, heat generated by the exposure device 32 is more easily transmitted to the attachment board 36, whereby the exposure device 32 is more effectively cooled.

Thus, the gap G2 is blocked by the sealing member 22, and therefore, when the cooling air F2 flows into the second recess portion 54 through the airflow opening 52*b*, a part of the cooling air F2 is prevented from flowing into the gaps G2 on the opposite sides of the second recess portion 54. In other words, the flow amount of the cooling air F2 flowing below the drive motor 453 is prevented from being reduced. As a result, the drive motor 453 can be more effectively cooled by the cooling air F2. In addition, in the second embodiment, the sealing member 22 is disposed in the gap G2, which is a simple configuration.

Third Embodiment

Figure 9:
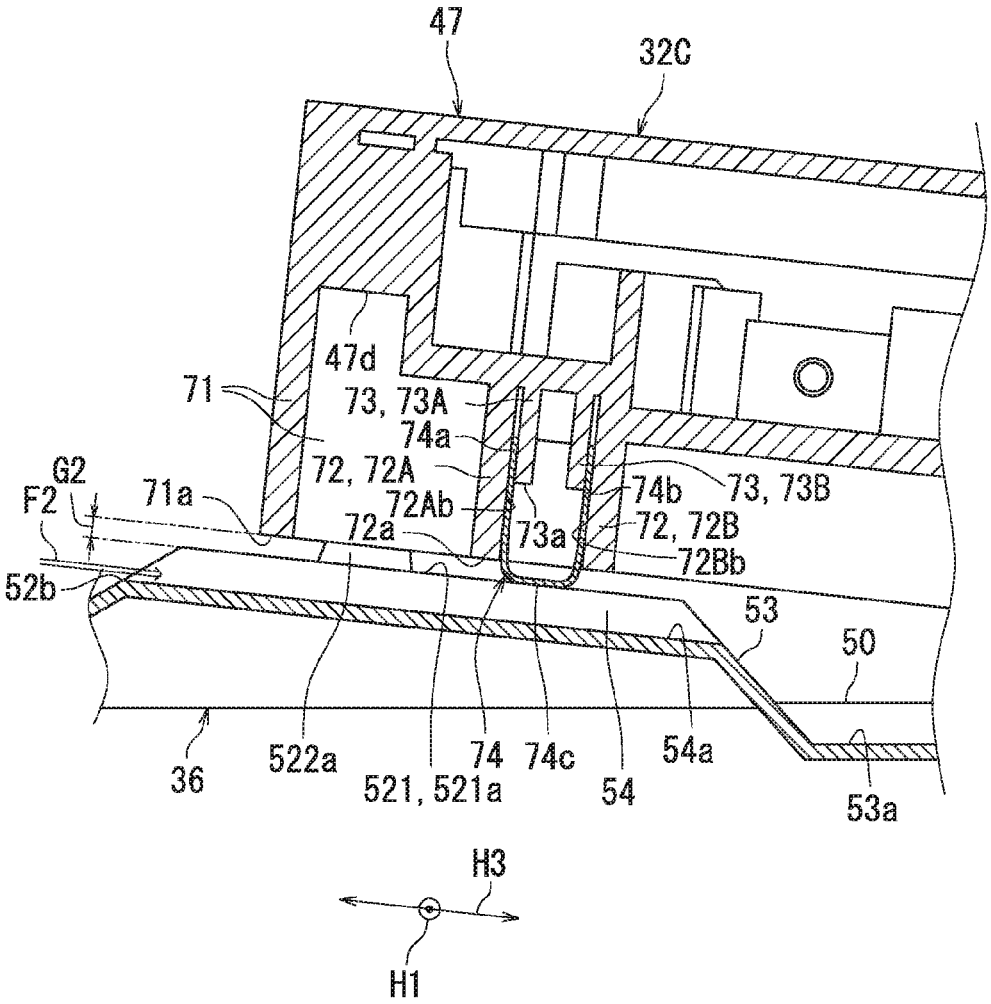
FIG. 9 is a side view showing a gap between an exposure device and an attachment board in a third embodiment.
Figure 10:
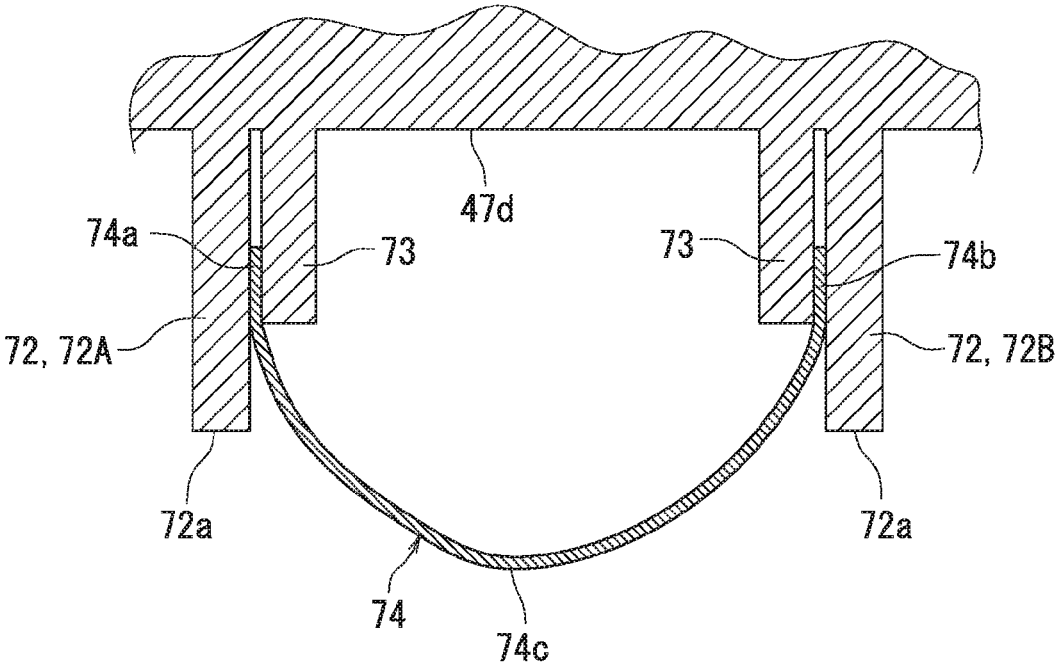
FIG. 10 is a cross-sectional view showing a sheet member according to the third embodiment.

In FIGS. 9 and 10, the same components as those of the first embodiment are indicated by the same reference signs and will not be described.

As shown in FIG. 9, an exposure device 32C according to a third embodiment includes, in addition to the components of the exposure device 32 of the first embodiment, a frame wall 71, a plurality of rib walls 72, a plurality of (e.g., two) sandwiching plates 73 (a first sandwiching plate and a second sandwiching plate), and a sheet member 74.

The frame wall 71 is provided at a perimeter of the lower surface 47*d* of the housing 47 of the exposure device 32C, in an upright position, extending downward.

The plurality of rib walls 72 are provided on the lower surface 47*d* of the housing 47, in an upright position, extending downward. The plurality of rib walls 72 are separated from each other and arranged in parallel in the front-rear direction (i.e., the transverse direction H3) of the lower surface 47*d*. The plurality of rib walls 72 extend in the left-and-right direction (i.e., the longitudinal direction H1) of the lower surface 47*d*. The opposite ends of the rib wall 72 in the extending direction are joined with, for example, the frame wall 71. A lower end surface of 72*a* of the rib wall 72 is located at the same height as that of a lower end surface 71*a* of the frame wall 71, for example.

The sandwiching plates 73 secure the sheet member 74 to the rib walls 72. The sandwiching plates 73 are provided on the lower surface 47*d* of the housing 47, in an upright position, extending downward. A lower end surface 73*a* of the sandwiching plate 73 is located higher than a lower end surface 72*a* of the rib wall 72, for example. Two sandwiching plates 73 are provided adjacent to counter-side surfaces 72Ab and 72Bb of a predetermined pair of rib walls 72A and 72B, respectively, in an upright position. The pair of rib walls 72A and 72B is two adjacent ones of the plurality of rib walls 72. Note that the frame wall 71 also functions as a rib wall 72. Therefore, the plurality of rib walls 72 include the frame wall 71. The pair of rib walls 72A and 72B is disposed above the region 521*a* of the mounting surface 521. The counter-side surface 72Ab and the counter-side surface 72Bb face each other.

The sheet member 74 blocks the gap G2 between the exposure device 32C and the attachment board 36. The sheet member 74 is in the shape of, for example, a film which is rectangular as viewed from above, and is flexible. The sheet member 74 is formed of an elastic material. The sheet member 74 has a thickness of, for example, 0.15-0.3 mm. The sheet member 74 may be formed from, for example, Lumirror (registered trademark).

Opposite end portions 74*a* and 74*b* of the sheet member 74 are secured to the counter-side surfaces 72Ab and 72Bb of the pair of rib walls 72A and 72B, respectively. Specifically, the end portion 74*a* of the sheet member 74 is sandwiched between the rib wall 72A and a sandwiching plate 73A to be secured to the counter-side surface 72Ab. The end portion 74*b* of the sheet member 74 is sandwiched between the rib wall 72B and a sandwiching plate 73B to be secured to the counter-side surface 72Bb.

Although, in the third embodiment, the end portion 74*a* of the sheet member 74 is sandwiched between the rib wall 72A and the sandwiching plate 73A to be secured to the counter-side surface 72Ab, the present disclosure is not limited to this. For example, the end portion 74*a* of the sheet member 74 may be stuck to the counter-side surface 72Ab to be secured to the counter-side surface 72Ab. In this case, the sandwiching plate 73A is omitted. Similarly, the end portion 74*b* of the sheet member 74 may be stuck to the counter-side surface 72Bb to be secured to the counter-side surface 72Bb.

A middle portion 74*c* of the sheet member 74 sags and is in contact with the region 521*a* of the mounting surface 521. When the middle portion 74*c* is in contact with the region 521*a*, the gap G2 is blocked in the transverse direction H3. Therefore, when the cooling air F2 flows into the second recess portion 54 through the airflow opening 52*b*, a part of the cooling air F2 is prevented from flowing through the gaps G2 on the opposite sides of the airflow opening 52*b*. As a result, the cooling air F2 can more effectively cool the drive motor 453. In addition, in the third embodiment, a part of the cooling air F2 flowing through the gap G2 is blocked by utilizing the elasticity of the sheet member 74, resulting in a simple configuration.

As shown in FIG. 10, when the exposure device 32C is not attached to the attachment board 36, the middle portion 74*c* of the sheet member 74 sags below the lower end surface 72*a* of the rib wall 72. Therefore, when the exposure device 32C is attached to the attachment board 36 (see FIG. 9), the middle portion 74*c* is strongly pressed against the region 521*a* by the elastic force of the sheet member 74. As a result, a part of the cooling air F2 flowing through the gap G2 is reliably blocked.

In the foregoing, embodiments of the present disclosure have been described with reference to the drawings (FIGS. 1-10). Note that the drawings mainly illustrate the components schematically for ease of understanding. The thicknesses, lengths, number, etc., of the components shown are not to scale for the sake of convenience of illustration. The materials, shapes, dimensions, etc., of the components illustrated in the above embodiments are only for illustrative purposes and are not particularly limited, and may be changed and modified without substantially departing the advantages of the present disclosure.

What is claimed is:

1. An image forming apparatus comprising:

an optical system unit configured to form an electrostatic latent image by irradiating an image bearing member with light; and an attachment board on which the optical system unit is attached, wherein the attachment board includes a mounting surface on which the optical system unit is mounted, and a first recess portion and a second recess portion provided in the mounting surface to form air paths, the first recess portion is located below a lower surface of the optical system unit, extending in a first direction, the second recess portion is located below the lower surface of the optical system unit, extending in a direction different from the first direction and crossing the first recess portion, the optical system unit includes a plurality of rib walls provided on the lower surface of the optical system unit in an upright position, and a sheet member that is flexible, and the sheet member has opposite end portions attached to respective counter-side surfaces of two adjacent ones of the plurality of rib walls, and a middle portion sagging and in contact with the mounting surface.

2. The image forming apparatus according to claim 1, wherein the optical system unit includes a light source, a rotating polygon mirror for reflecting light emitted by the light source, and an electric motor for driving the rotating polygon mirror to rotate, and one of the first recess portion and the second recess portion is located below the electric motor.

3. The image forming apparatus according to claim 1, further comprising:

a sealing member that is thermally conductive, wherein the sealing member is sandwiched between the mounting surface and the lower surface of the optical system unit.

4. The image forming apparatus according to claim 1, wherein a bottom surface of the second recess portion is located at a height different from that of a bottom surface of the first recess portion.

5. The image forming apparatus according to claim 1, wherein the mounting surface is substantially rectangular, the first recess portion is disposed at substantially the center in a transverse direction of the mounting surface, extending in a longitudinal direction of the mounting surface, and the second recess portion is disposed at substantially the center in the longitudinal direction of the mounting surface, extending in the transverse direction of the mounting surface.

6. The image forming apparatus according to claim 1, further comprising:

a first and a second sandwiching plate provided on the lower surface of the optical system unit in an upright position, wherein the first sandwiching plate is disposed adjacent to one of the counter-side surfaces of the two adjacent rib walls, in an upright position, the second sandwiching plate is disposed adjacent to the other of the counter-side surfaces of the two adjacent rib walls, in an upright position, a one end portion of the sheet member is sandwiched between the first sandwiching plate and the one counter-side surface to be attached to the one counter-side surface, and another end portion of the sheet member is sandwiched between the second sandwiching plate and the other counter-side surface to be attached to the other counter-side surface.

7. An image forming apparatus comprising:

an optical system unit configured to form an electrostatic latent image by irradiating an image bearing member with light; and an attachment board on which the optical system unit is attached, wherein the attachment board includes a mounting surface on which the optical system unit is mounted, and a first recess portion and a second recess portion provided in the mounting surface to form air paths, the first recess portion is located below a lower surface of the optical system unit, extending in a first direction, and the second recess portion is located below the lower surface of the optical system unit, extending in a direction different from the first direction and crossing the first recess portion, the image forming apparatus further comprising a first air blower and a second air blower, wherein the first air blower supplies cooling air to the first recess portion, and the second air blower supplies cooling air to the second recess portion.

8. The image forming apparatus according to claim 7, wherein the optical system unit includes a light source, a rotating polygon mirror for reflecting light emitted by the light source, and an electric motor for driving the rotating polygon mirror to rotate, and one of the first recess portion and the second recess portion is located below the electric motor.

9. The image forming apparatus according to claim 7, wherein the optical system unit includes a plurality of rib walls provided on the lower surface of the optical system unit in an upright position, and a sheet member that is flexible, and the sheet member has opposite end portions attached to respective counter-side surfaces of two adjacent ones of the plurality of rib walls, and a middle portion sagging and in contact with the mounting surface.

10. The image forming apparatus according to claim 7, wherein a bottom surface of the second recess portion is located at a height different from that of a bottom surface of the first recess portion.

11. The image forming apparatus according to claim 7, wherein the mounting surface is substantially rectangular, the first recess portion is disposed at substantially the center in a transverse direction of the mounting surface, extending in a longitudinal direction of the mounting surface, and the second recess portion is disposed at substantially the center in the longitudinal direction of the mounting surface, extending in the transverse direction of the mounting surface.

12. The image forming apparatus according to claim 11, further comprising:

a first and a second sandwiching plate provided on the lower surface of the optical system unit in an upright position, wherein the first sandwiching plate is disposed adjacent to one of counter-side surfaces of two adjacent rib walls, in an upright position, the second sandwiching plate is disposed adjacent to the other of the counter-side surfaces of the two adjacent rib walls, in an upright position, a one end portion of the sheet member is sandwiched between the first sandwiching plate and the one counter-side surface to be attached to the one counter-side surface, and another end portion of the sheet member is sandwiched between the second sandwiching plate and the other counter-side surface to be attached to the other counter-side surface.

13. An image forming apparatus, comprising:

an optical system unit configured to form an electrostatic latent image by irradiating an image bearing member with light; and an attachment board on which the optical system unit is attached, wherein the attachment board includes a mounting surface on which the optical system unit is mounted, and a first recess portion and a second recess portion provided in the mounting surface to form air paths, the first recess portion is located below a lower surface of the optical system unit, extending in a first direction, the second recess portion is located below the lower surface of the optical system unit, extending in a direction different from the first direction and crossing the first recess portion, the mounting surface is inclined with respect to a horizontal direction, the first recess portion is inclined with respect to the horizontal direction, and the second recess portion extends in the horizontal direction.

14. The image forming apparatus according to claim 13, wherein the optical system unit includes a light source, a rotating polygon mirror for reflecting light emitted by the light source, and an electric motor for driving the rotating polygon mirror to rotate, and one of the first recess portion and the second recess portion is located below the electric motor, the optical system unit further include an fθ lens, the first recess portion is located below the fθ lens, and the second recess portion is located below the electric motor.

15. The image forming apparatus according to claim 13, wherein the optical system unit includes a light source, a rotating polygon mirror for reflecting light emitted by the light source, and an electric motor for driving the rotating polygon mirror to rotate, and one of the first recess portion and the second recess portion is located below the electric motor.

16. The image forming apparatus according to claim 13, wherein the optical system unit includes a plurality of rib walls provided on the lower surface of the optical system unit in an upright position, and a sheet member that is flexible, and the sheet member has opposite end portions attached to respective counter-side surfaces of two adjacent ones of the plurality of rib walls, and a middle portion sagging and in contact with the mounting surface.

17. The image forming apparatus according to claim 16, further comprising:

a first and a second sandwiching plate provided on the lower surface of the optical system unit in an upright position, wherein the first sandwiching plate is disposed adjacent to one of the counter-side surfaces of the two adjacent rib walls, in an upright position, the second sandwiching plate is disposed adjacent to the other of the counter-side surfaces of the two adjacent rib walls, in an upright position, a one end portion of the sheet member is sandwiched between the first sandwiching plate and the one counter-side surface to be attached to the one counter-side surface, and another end portion of the sheet member is sandwiched between the second sandwiching plate and the other counter-side surface to be attached to the other counter-side surface.

18. The image forming apparatus according to claim 13, wherein a bottom surface of the second recess portion is located at a height different from that of a bottom surface of the first recess portion.

19. The image forming apparatus according to claim 13, wherein the mounting surface is substantially rectangular, the first recess portion is disposed at substantially the center in a transverse direction of the mounting surface, extending in a longitudinal direction of the mounting surface, and the second recess portion is disposed at substantially the center in the longitudinal direction of the mounting surface, extending in the transverse direction of the mounting surface.

20. The image forming apparatus according to claim 13, further comprising:

a first air blower and a second air blower, wherein the first air blower supplies cooling air to the first recess portion, and the second air blower supplies cooling air to the second recess portion.

* * * * *